US007273430B2

(12) United States Patent
Ashino et al.

(10) Patent No.: US 7,273,430 B2
(45) Date of Patent: Sep. 25, 2007

(54) TENNIS RACKET FRAME

(75) Inventors: Takeshi Ashino, Hyogo (JP); Kunio Niwa, Hyogo (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/407,092

(22) Filed: Apr. 20, 2006

(65) Prior Publication Data

US 2006/0281590 A1 Dec. 14, 2006

(30) Foreign Application Priority Data

Jun. 8, 2005 (JP) ..... 2005-168838

(51) Int. Cl.
*A63B 49/02* (2006.01)
*A63B 49/10* (2006.01)

(52) U.S. Cl. ..... 473/535; 473/524; 473/537

(58) Field of Classification Search ..... 473/535–537, 473/524, 547

See application file for complete search history.

(56) References Cited

U.S. PATENT DOCUMENTS

| | | | | |
|---|---|---|---|---|
| 5,575,875 | A * | 11/1996 | Brittingham et al. | 156/175 |
| 6,088,947 | A * | 7/2000 | Suzue et al. | 43/18.1 R |
| 6,652,969 | B1 * | 11/2003 | Murakami et al. | 428/408 |
| 6,893,720 | B1 * | 5/2005 | Nakahigashi et al. | 428/408 |
| 2003/0064838 | A1 * | 4/2003 | Ashino et al. | 473/535 |

FOREIGN PATENT DOCUMENTS

| | | |
|---|---|---|
| JP | 10-24575 A | 1/1998 |
| JP | 2940397 B2 | 6/1999 |

* cited by examiner

*Primary Examiner*—Raleigh W. Chiu
(74) *Attorney, Agent, or Firm*—Birch, Stewart, Kolasch & Birch, LLP

(57) ABSTRACT

A tennis racket frame is composed of a laminate of prepregs each containing carbon fibers serving as a reinforcing fiber thereof. At least one part of layers of the laminate is formed as a hard layer consisting of a prepreg composed of the reinforcing carbon fibers and a hard carbon film (DLC film) formed on the surface of the carbon fibers.

9 Claims, 9 Drawing Sheets

[Prior Art]

TENNIS RACKET FRAME

This nonprovisional application claims priority under 35 U.S.C. § 119(a) on Patent Application No(s). 2005-168838 filed in Japan on Jun. 8, 2005, the entire contents of which are hereby incorporated by reference.

BACKGROUND OF THE INVENTION

Field of the Invention

The present invention relates to a tennis racket frame and more particularly to a tennis racket frame made of a fiber reinforced resin containing a reinforcing fiber improved to enhance the rigidity, restitution performance, and face stability thereof.

In recent years, female and senior players having a small power strongly demand for the development of a racket having a high rebounding performance. Therefore not metal or wood but a fiber reinforced resin is the most popular material for the racket frame because the fiber reinforced resin is lightweight and high in its specific strength and the degree of freedom in design.

But from the standpoint of a collision between the racket frame and a ball, in accordance with the law of conservation of energy, the lighter the racket frame is, the lower its restitution coefficient is. That is, making the racket frame lightweight causes the restitution performance thereof to deteriorate.

To solve the above-described problem, it is conceivable to enhance the moment of inertia in a swing direction by increasing the thickness of the racket frame or by disposing the center of gravity thereof at a position located near the head thereof. However, when the thickness of the racket frame is increased without increasing the weight thereof, the wall thickness thereof becomes small. Thereby the strength and rigidity of the racket frame deteriorate. When the moment of inertia in the swing direction is increased, a player feels that a racket is heavy and hence the operability thereof will deteriorate. To solve the above-described problem, it is also conceivable to mount a restitutory construction on the racket frame. But the mounting of the restitutory construction on the racket frame increases the weight of the racket frame and thus the operability thereof will deteriorate. Thus it is necessary to keep the weight of the racket frame lightweight and enhance the rigidity thereof to increase the operability and restitution performance thereof.

To enhance the resistance to wear and scratching, proposed in Patent Publication No. 2940397 (patent document 1) and Japanese Patent Application Laid-Open No. 10-24575 (patent document 2) is the formation of the (hard) carbon film on a molded product such as a racket frame, a golf club shaft, and the like made of fiber reinforced resin, as shown in FIG. 12. But the (hard) carbon film serves to merely treat the surface of the molded product and does not contribute to improvement of the rigidity and strength thereof.

Patent document 1: Patent Publication No. 2940397

Patent document 2: Japanese Patent Application Laid-Open No. 10-24575

SUMMARY OF THE INVENTION

The present invention has been made in view of the above-described problems. Therefore it is an object of the present invention to provide a tennis racket frame which is lightweight, has a high rigidity, and has excellent restitution performance and face stability.

To achieve the above-described object, the present invention provides a tennis racket frame, made of a fiber reinforced resin, which has a plurality of reinforcing fibers including a carbon fiber and a hard carbon film, which is formed on a surface of the carbon fiber.

It is preferable that the hard carbon film consists of a diamond-like carbon (DLC) film. The DLC film has an amorphous construction and its hardness is as high as diamond. Thus the DLC film has properties superior in its wear resistance, corrosion resistance, and smoothness. The thickness of the DLC film is selected in the range of 0.1 μm to 10 μm in view of a favorable balance between the suppression of an increase in the weight of the racket frame and the improvement of the hardness thereof. The thickness of the DLC film is preferably about 1 μm.

The hard carbon film and particularly the DLC film is capable of imparting a high hardness to a base material of the racket frame, even though it is very thin. Therefore by coating the surface of the reinforcing fiber with the hard carbon film, it is possible to suppress the increase of the weight of the racket frame and yet enhance the rigidity, wear resistance, and smoothness thereof. Therefore it is possible to enhance the rigidity of the racket frame, made of the fiber reinforced resin, in which the carbon fiber coated with the hard carbon film is used as the reinforcing fiber. Thereby it is possible to improve the restitution performance of the racket frame and reduce the loss of energy caused by deformation of the racket frame and improve the face stability thereof.

The method of forming the hard carbon film includes a high-frequency plasma CVD method, an ionizing evaporation method, an arc ion-plating method, and the like. These methods are capable of forming a film at not more than 200° C. But in view of mass productivity, the high-frequency plasma CVD method is preferable.

It is preferable to use the fiber reinforced resin containing the carbon fiber in the form of a prepreg composed of reinforcing fibers impregnated with a matrix resin, with the reinforcing fibers drawn and arranged in one direction. It is also preferable that the racket frame is composed of a laminate of the prepregs. Therefore the carbon fiber coated with the hard carbon film is also used as the reinforcing fiber of the prepreg.

In manufacturing a racket frame made of the fiber reinforced resin, it is possible to wind the carbon fibers coated with the hard carbon film round a mandrel by using a filament winding method to form a preform and thereafter impregnate the preform with resin.

To improve the adhesiveness of the carbon fiber to the matrix resin in forming the prepreg by impregnating the carbon fiber with the matrix resin, the surface of the carbon fiber is treated by liquid phase oxidation, electrolytic oxidation or gaseous phase oxidation.

To improve processability of a high order, the sizing agent is applied to the surface of the carbon fiber. As the sizing agent, epoxy organic compounds or inorganic compounds are used. When epoxy resin is used as the matrix resin, the epoxy organic compounds are frequently selected.

In the present invention, it is possible to use a carbon fiber whose surface is oxidized, a carbon fiber coated with the sizing agent consisting of an organic compound or an inorganic compound, and a carbon fiber which is surface-treated and sizing-treated.

In the present invention, it is preferable that the sizing agent is applied to the surface of the carbon fiber and that after the sizing agent is cleaned, the surface of the carbon fiber is coated with the hard carbon film.

That is, the adhesiveness of the carbon fiber coated with the sizing agent such as the epoxy resin to the hard carbon film is likely to be low. Thus it is preferable that after the sizing agent is removed from the surface of the carbon fiber, the hard carbon film is formed on the surface of the carbon fiber. Thereby the adhesiveness of the carbon fiber to the hard carbon film becomes high, and the rigidity of the racket frame that is a molded product is improved.

The sizing agent can be cleaned by supersonic cleaning in which a solvent of MEK and the like is used.

To form the prepreg, fibers are wound round a drum at a predetermined equal angle, with the fibers kept immersed in the matrix resin. After a predetermined amount of the fibers impregnated with the matrix resin is wound round the drum, they are cut off from the drum. Thereafter they are heated at 80° C. to 100° C. to perform pseudo curing. The prepreg obtained in this manner is used in the present invention. In the above-described drum winding method, because the fibers are wound round the drum at the predetermined equal angle, it is possible to freely adjust the fibrous angle of the fibers and dispose them in correspondence to various deformations of the racket frame.

However, it is difficult to apply the hard carbon film to fibers arranged at an equal angle. Thus in the present invention, in forming the prepreg containing the reinforcing carbon fibers coated with the hard carbon film, after warps and wefts thereof are braided into a piece of cloth, the cloth is coated with the hard carbon film. Thereafter the cloth is impregnated with the epoxy resin.

As the reinforcing fiber of the fiber reinforced resin constituting the tennis racket frame, in addition to the carbon fiber, glass fibers may be disposed on the outer surface of the tennis racket frame. It is preferable that the fiber reinforced resin contains other kinds of reinforcing fibers in addition to the carbon fiber.

However, it is possible to enhance the rigidity of the tennis racket frame and improve its restitution performance by using the carbon fiber mostly as the reinforcing fiber and coating the surface of the carbon fiber with the hard carbon film.

It is preferable to form the tennis racket frame of the present invention by molding a laminate of about 10 layers of the prepreg. The number of the layers of the prepreg composed of the reinforcing carbon fiber coated with the hard carbon film (referred to as "hard layers") is favorably not less than one, more favorably not less than two nor more than seven, and most favorably not less than three nor more than five. If the number of the hard layers is not less than eight, there is a large increase in the weight of the racket frame. Thereby the racket frame will deteriorate in its face stability.

As described above, in the racket frame of the present invention made of the fiber reinforced resin, the reinforcing carbon fiber is coated with the hard carbon film to improve the hardness thereof. Therefore it is possible to restrain the increase of the weight of the racket frame and yet enhance the rigidity thereof. Thereby it is possible to improve the restitution performance of the racket frame and the face stability thereof.

When the sizing agent is applied to the carbon fiber, after the sizing agent is cleaned, the hard carbon film is applied to the surface of the carbon fiber. Thereby it is possible to enhance the adhesiveness of the carbon fiber to the hard carbon film.

BRIEF DESCRIPTION OF THE DRAWINGS

FIG. 3 shows carbon fibers of a hard layer of the racket frame, in which

DETAILED DESCRIPTION OF THE PREFERRED EMBODIMENTS

The embodiments of the present invention will be described below with reference to the drawings. The embodiments which will be described below are applied to a racket for use in regulation-ball tennis.

Figure 1:
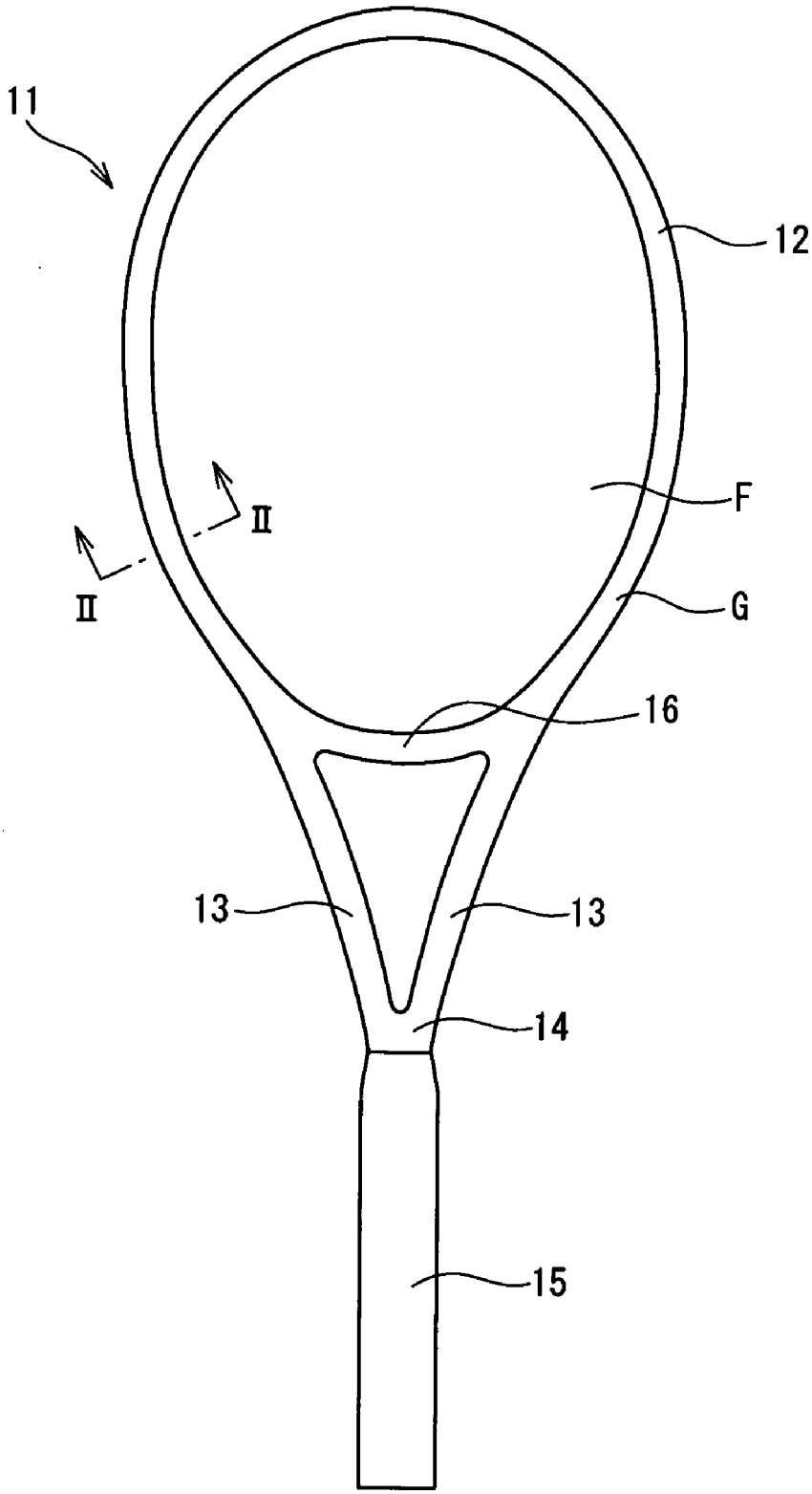
FIG. 1 is a front view showing a racket frame of a first embodiment of the present invention.

FIGS. 1 through 3 show a racket frame 11 of the first embodiment of the present invention.

The racket frame 11 has a head part 12, a throat part 13, a shaft part 14, and a grip part 15. These parts are continuously formed. The throat part 13 continuous with the head part 12 and with the shaft part 14 is bifurcated. A yoke part 16 is provided between both frames of the throat part 13. The yoke part 16 and the head part 12 form a string-stretched portion G surrounding a ball-hitting face F. A string groove 18 is concavely formed on the outer surface of the head part 12.

The racket frame 11 is formed as a continuous pipe consisting of a laminate of wound prepreg sheets 21 (21*a*, 21*b*) each composed of carbon fibers 22 impregnated with epoxy resin.

Figure 2A:
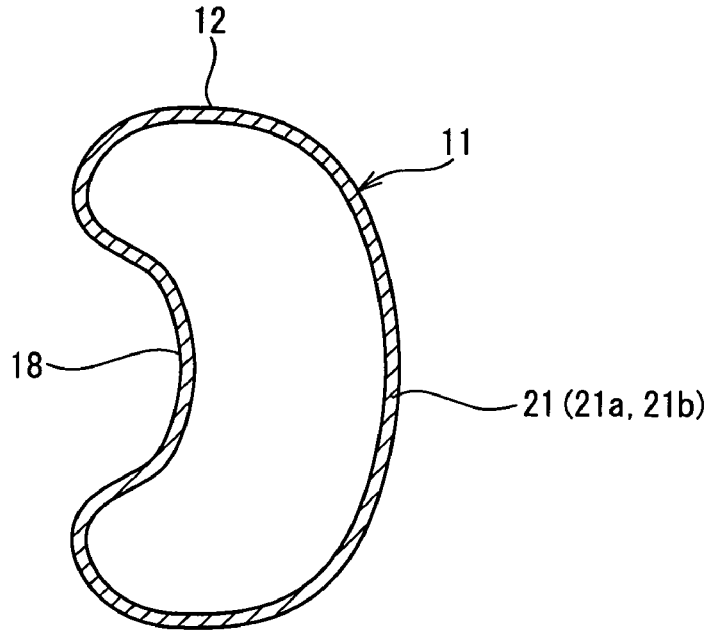
FIG. 2A is a schematic sectional view taken along a line II-II of FIG. 1.
Figure 2B:
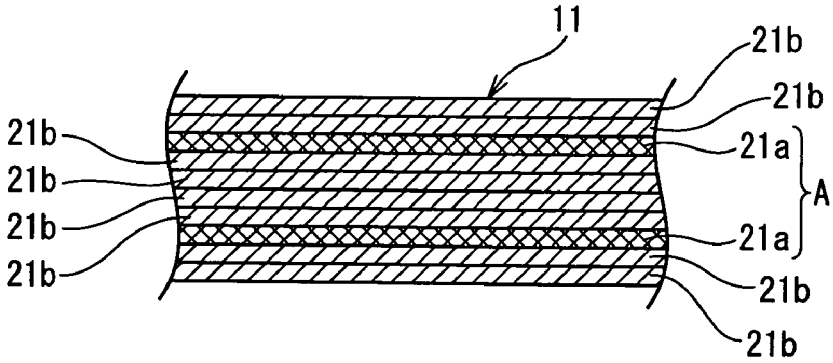
FIG. 2B is a partly enlarged sectional view showing the construction of a laminate of layers.
Figure 3A:
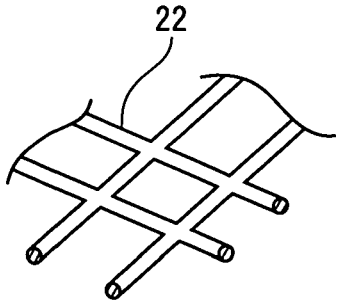
FIG. 3A is a perspective view showing the configuration of the arranged carbon fibers.
Figure 3B:
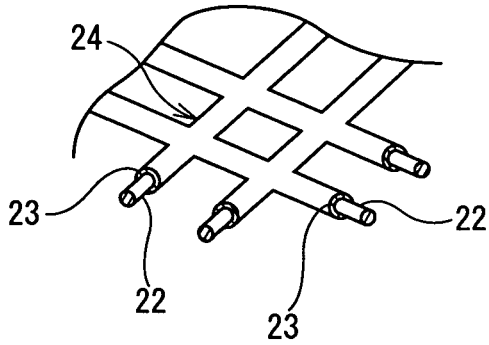
FIG. 3B is a perspective view showing the carbon fibers after a DLC film is formed thereon.

More specifically, as shown in FIGS. 2A and 2B, the racket frame 11 consists of a laminate of 10 layers of the prepreg sheets 21. A third layer and an eighth layer from an innermost layer is formed as a hard layer A. As shown in FIGS. 3A and 3B, the hard layer A consists of the prepreg sheet 21*a* composed of the carbon fibers 22 braided into a piece of cloth and a DLC film 23, having a thickness of 1 μm, which is formed on the surface of the carbon fiber 22.

A carbon fiber (hereinafter referred to as "coated fiber") 24 coated with the DLC film 23 is impregnated with epoxy resin.

The layers other than the hard layer A consist of the prepreg sheet 21*b* composed of the carbon fibers 22, impregnated with epoxy resin, which are drawn and arranged in one direction by a drum winding method.

Each of the two of the 10 layers constituting the racket frame 11 having the above-described construction consists of the hard layer A consisting of the prepreg sheet 21*a* containing the coated fiber 24. The hard layer A enhances the hardness of the carbon fiber 22. Thereby it is possible to enhance the rigidity of the racket frame 11 and thus the restitution performance and face stability thereof. The DLC film 23 is very thin and little increases the weight of the racket frame 11. Therefore the racket frame 11 is allowed to have a high rigidity and a light weight.

Figure 4:
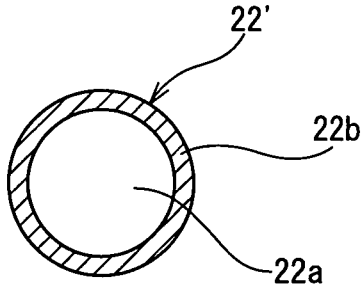
FIG. 4 is a sectional view showing a carbon fiber constituting a hard layer of a racket frame of a second embodiment of the present invention.
Figure 5:
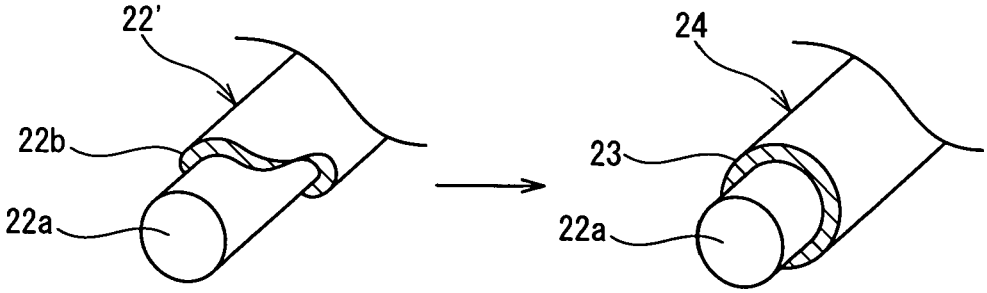
FIG. 5 is an enlarged explanatory view showing cleaning of a sizing agent applied to the surface of the carbon fibers.

FIGS. 4 and 5 show the second embodiment of the present invention.

In the second embodiment, as shown in FIG. 4, a carbon fiber 22' constituting the hard layer A is composed of a fiber body 22*a* and an epoxy sizing agent 22*b* which is applied to the surface of the fiber body 22*a*. As shown in FIG. 5, after the sizing agent 22*b* is removed from the fiber 22*a* by cleaning, the DLC film 23 is applied to the surface of the fiber 22*a* to form the coated fiber 24.

Figure 6:
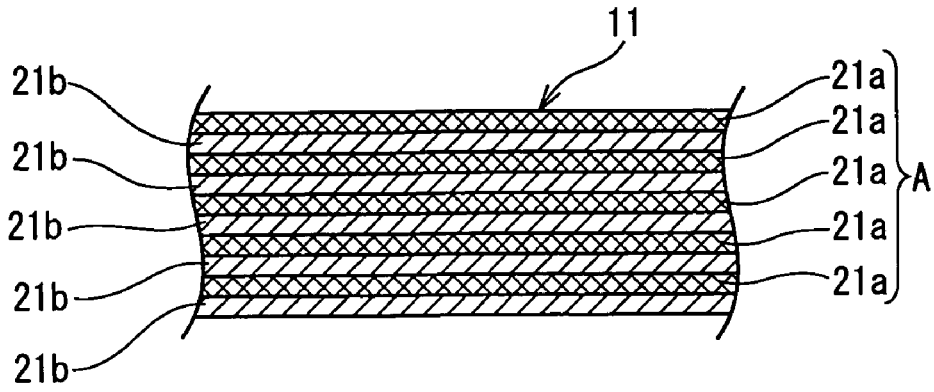
FIG. 6 is a partly enlarged sectional view showing the construction of a laminate of layers of a racket frame of a third embodiment of the present invention.

FIG. 6 shows the third embodiment of the present invention.

A racket frame 11 of the third embodiment is constituted of 10 layers each consisting of the prepreg sheet 21. Second, fourth, sixth, eighth, and tenth layers from the inner most layer are composed of the hard layer A consisting of the prepreg sheet 21*a*. Each of the other layers consists of the prepreg sheet 21*b* not containing the coated fiber 24.

Figure 7:
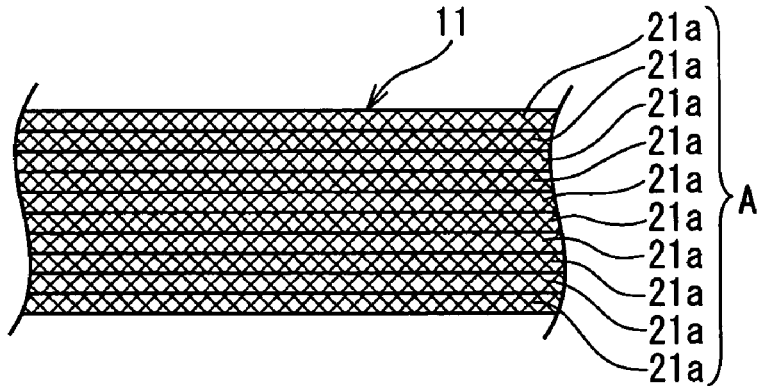
FIG. 7 is a partly enlarged sectional view showing the construction of a laminate of layers of a racket frame of a fourth embodiment of the present invention.

FIG. 7 shows the fourth embodiment of the present invention.

In the fourth embodiment, every layer of the racket frame 11 is composed of the hard layer A. That is, each of the prepreg 21 constituting the racket frame 11 consists of the prepreg sheet 21*a* containing the coated fiber 24.

EXAMPLES

As shown in table 1, the racket-frame of each of the examples 1 through 4 and the comparison example 1 was prepared. Except the racket frame of the comparison example 1, the carbon fiber was coated with the coated film. Except the racket frames of the example 1 and the comparison example 1, the surface of the carbon film was treated with the sizing agent (pretreatment). The racket frames had different number of the hard layers A. The rigidities, restitution coefficients, and regions of restitution of the racket frames of the racket frames were measured. A ball-hitting test was conducted to examine the rebounding performances and face stabilities of the racket frames.

TABLE 1

| | | Example ① | Example ② | Example ③ | Example ④ | Comparison Example ① |
|---|---|---|---|---|---|---|
| Carbon fiber coated with hard carbon film | Coating film | DLC | DLC | DLC | DLC | Not formed |
| | Pretreatment | Not pretreated | Pretreated | Pretreated | Pretreated | Not pretreated |
| | Number of hard layers | Two layers | Two layers | Five layers | 10 layers | Nothing |
| Weight (g)/balance (mm) | | 270/340 | 271/340 | 273/342 | 275/343 | 270/340 |
| Rigidity (kgf/cm) | Ball-hitting face | 152 | 155 | 160 | 171 | 143 |
| | Rigidity value of side surface | 75 | 78 | 82 | 90 | 70 |
| Maximum restitution coefficient | | 0.402 | 0.405 | 0.411 | 0.418 | 0.391 |
| High-restitution region ($cm^2$) | | 35 | 40 | 48 | 59 | 28 |
| Ball-hitting test | Rebounding performance | 3.56 | 3.66 | 3.88 | 4.02 | 3.12 |
| | Face stability | 3.49 | 3.56 | 3.72 | 3.32 | 3.08 |

The racket frame 11 of each of the examples 1 through 4 and the comparison example 1 was made of fiber reinforced thermosetting resin. They were hollow and had the same shape. More specifically, each racket frame 11 had 100 square inches in the ball-hitting face thereof. The weight of each racket frame 11 and the frame balance thereof were set as shown in table 1.

More specifically, prepreg sheets 21 each consisting of fiber reinforced thermosetting resin were layered on a mandrel coated with an internal-pressure tube made of nylon 66 to obtain a laminate of 10 prepreg sheets 21. The above-described fiber reinforced thermosetting resin was composed of the reinforcing carbon fibers 22 impregnated with a matrix resin consisting of epoxy resin. The laminate was molded. More specifically, the fibrous angles of the carbon fibers 22 of the hard layer A were all set to ±45°, whereas the fibrous angles of the carbon fibers 22 of the other layers were set to 0°, 22°, 30° or 90°. After the mandrel was removed from the laminate, the laminate was set in a die. Thereafter the die was clamped and heated for 30 minutes to raise the temperature of the die to 150° C., with an air pressure of 9 $kgf/cm^2$ kept inside the internal tube to prepare the racket frames.

Of the prepreg sheets 21 used for the racket frames of the examples and the comparison examples, 3K carbon cloth (W-3101 manufactured by Toho Rayon Inc.), warps and wefts of which were braided was used as the carbon fiber of the prepreg sheet 21*a* composing the hard layer A. A sizing agent consisting of the epoxy resin was applied to the surface of the fibers of the 3K carbon cloth.

The carbon fibers of the prepreg sheet 21*b* constituting the layers other than the hard layer A were wound round a drum at a predetermined equal angle, with the carbon fibers kept immersed in the epoxy resin. After a predetermined amount of the carbon fibers impregnated with the epoxy resin were wound round the drum, they were cut off from the drum. Thereafter they were heated at 80° C. to 100° C. to perform pseudo curing. In this manner, the prepreg sheet 21*b* was obtained. The carbon fiber (T300, 700, 800, and M46J) was manufactured by Toray Industries Inc.

Figure 8:
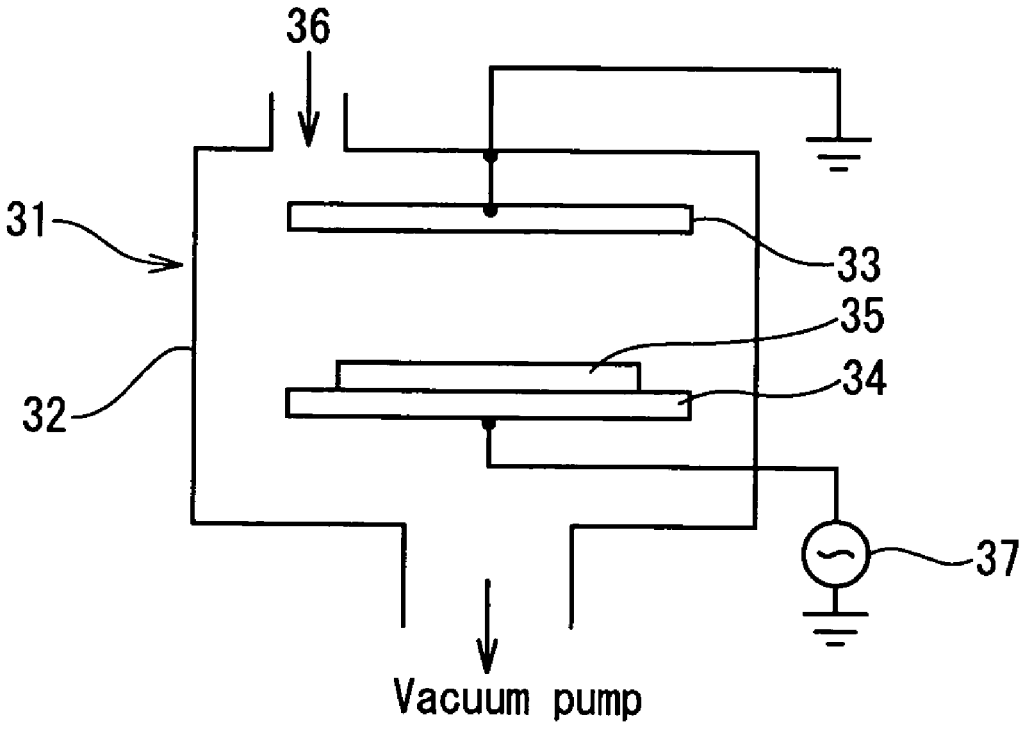
FIG. 8 is a schematic view showing a high-frequency plasma CVD apparatus.

To form the DLC film, as shown in FIG. 8, a high-frequency plasma CVD apparatus 31 was used. A flat anode electrode 33 and a cathode electrode 34 were set with both electrodes opposed to each other inside a vacuum container 32 of the high-frequency plasma CVD apparatus 31. With a base material 35 (3K carbon cloth) placed on the cathode electrode 34, a material gas 36 was introduced into the vacuum container 32. With a vacuum degree kept constant, a high-frequency electric power was supplied from a high-frequency power source 37, having a frequency of 13.56 MHz, which was connected with the cathode electrode 34 to generate plasma between the anode electrode 33 and the cathode electrode 34. Thereby the DLC film having a thickness of 1 μm was formed on the surface of the material 35.

The carbon fiber (3K carbon cloth) was pretreated (cleaning treatment by using sizing agent) by ultrasonic cleaning in which an MEK solvent was used.

Example 1

Similarly to the first embodiment, of 10 layers constituting the racket frame 11, a third layer and an eighth layer from an innermost layer were formed as the hard layer A respectively containing the prepreg sheet 21*a*. The other layers were composed of the prepreg sheet 21*b* respectively not containing the coated fiber. The sizing agent applied to the surface of the carbon fiber constituting the hard layer A was not cleaned, but the DLC film was formed on the sizing agent.

Example 2

After the sizing agent applied to the surface of the carbon fiber constituting the hard layer A was cleaned, the DLC film was formed on the surface of the carbon fiber. The other particulars of the racket frame of the example 2 were identical to those of the racket frame of the example 1.

Example 3

Similarly to the third embodiment, of 10 layers constituting the racket frame 11, each of second, fourth, sixth, eighth, and tenth layers was composed of the hard layer A consisting of the prepreg sheet 21*a*. Each of the other layers was composed of the prepreg sheet 21*b* not containing the coated fiber. After the sizing agent applied to the surface of the carbon fiber constituting the hard layer A was cleaned, the DLC film was formed on the surface of the carbon fiber.

Example 4

Similarly to the fourth embodiment, all of 10 layers of the racket frame 11 were composed of the hard layer A consisting of the prepreg sheet 21*a*. After the sizing agent applied to the surface of the carbon fiber constituting the hard layer A was cleaned, the DLC film was formed on the surface of the carbon fiber.

Comparison Example 1

Each of 10 layers constituting the racket frame 11 was composed of the prepreg sheet 21*b* not containing the coated fiber.

Measurement of Rigidity of Ball-Hitting Face

Figure 9A:
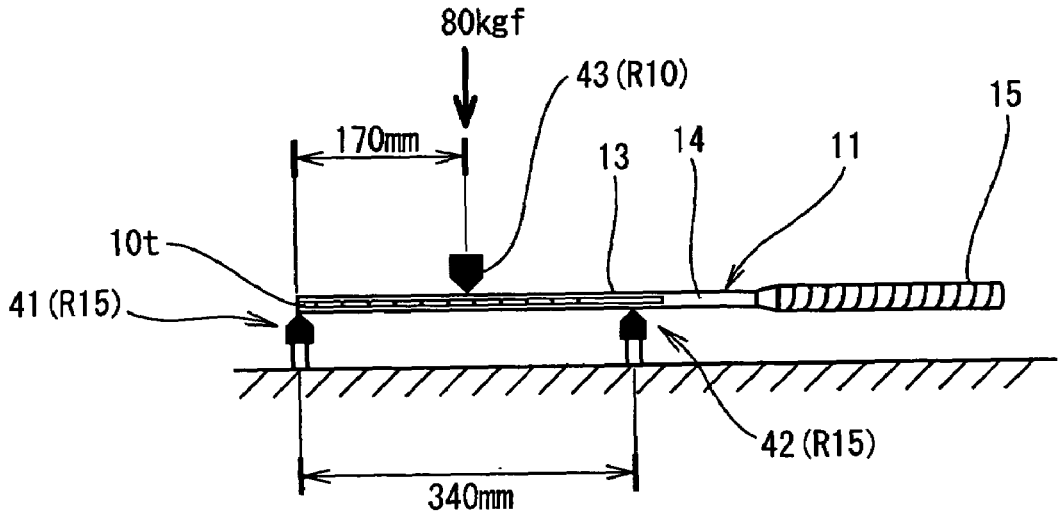
FIGS. 9A and 9B are schematic views each showing the method of measuring the rigidity value of the ball-hitting face of a racket frame.
Figure 9B:
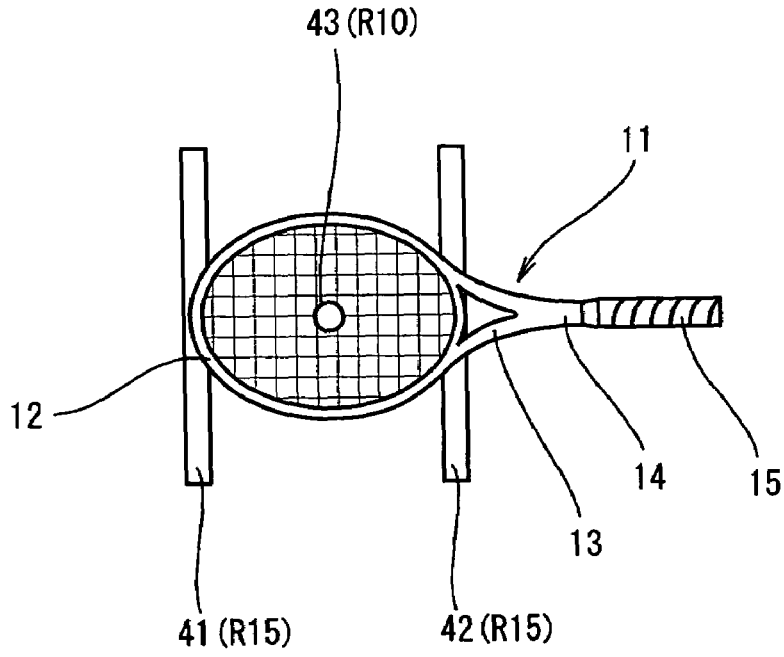

As shown in FIGS. 9A and 9B, tennis rackets prepared by stretching strings on the racket frames 11 of the examples and the comparison examples were horizontally disposed. The top position of the head part 12 was supported by a receiving jig 41 (R15). A position, spaced by 340 mm from the top position, which was located in the range between the throat pats 13 and the yoke part 16 was supported by a receiving jig 42 (R15). In this state, a load of 80 kgf was applied downward to a position spaced by 170 mm from the position of the jig 41 by means of a pressurizing instrument 43 (R10). The applied load of 80 kgf was divided by a measured displaced amount (flexed amount (cm)) of the ball-hitting face of each racket frame 11 to obtain the rigidity value thereof in the out-of-plane direction of the ball-hitting face.

Measurement of Rigidity Value of Side Surface

Figure 10:
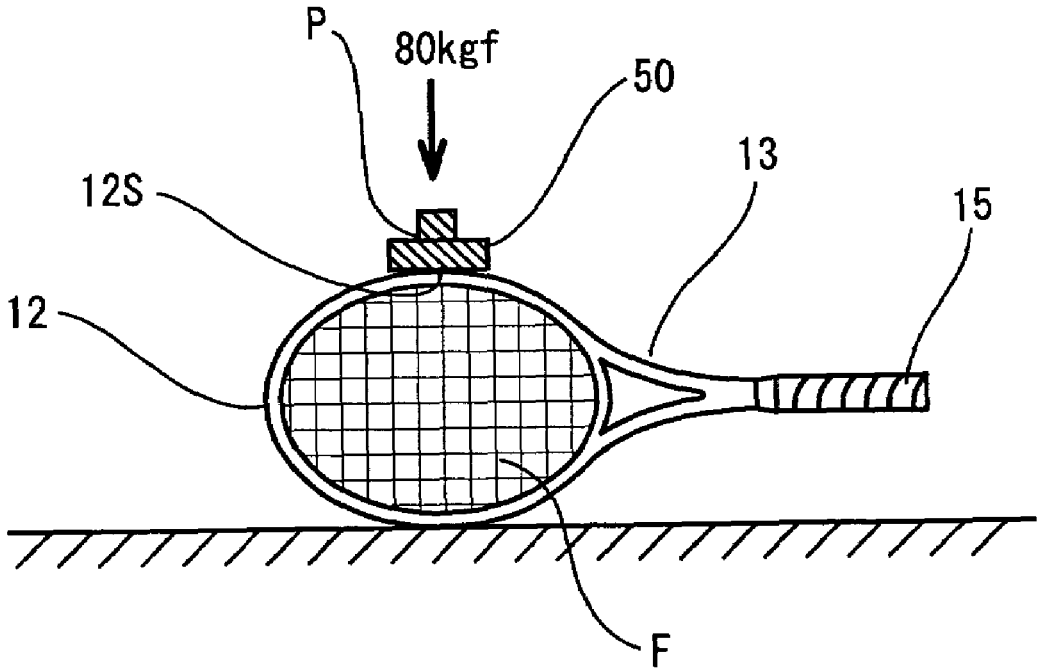
FIG. 10 is a schematic view showing the method of measuring the rigidity value of the side surface of the racket frame.

As shown in FIG. 10, the tennis racket of each of the examples and the comparison examples was held sideways with the ball-hitting face F thereof kept vertical. In this state, a load of 80 kgf was applied to an upper side surface 12*s* of the head part 12 by means of a flat plate P. The applied load of 80 kgf was divided by a measured displaced amount (flexed amount (cm)) of the side surface 12*s* to obtain the rigidity value thereof in the in-plane direction of the ball-hitting face.

Measurement of Maximum Restitution Coefficient and High-Restitution Region

Figure 11:
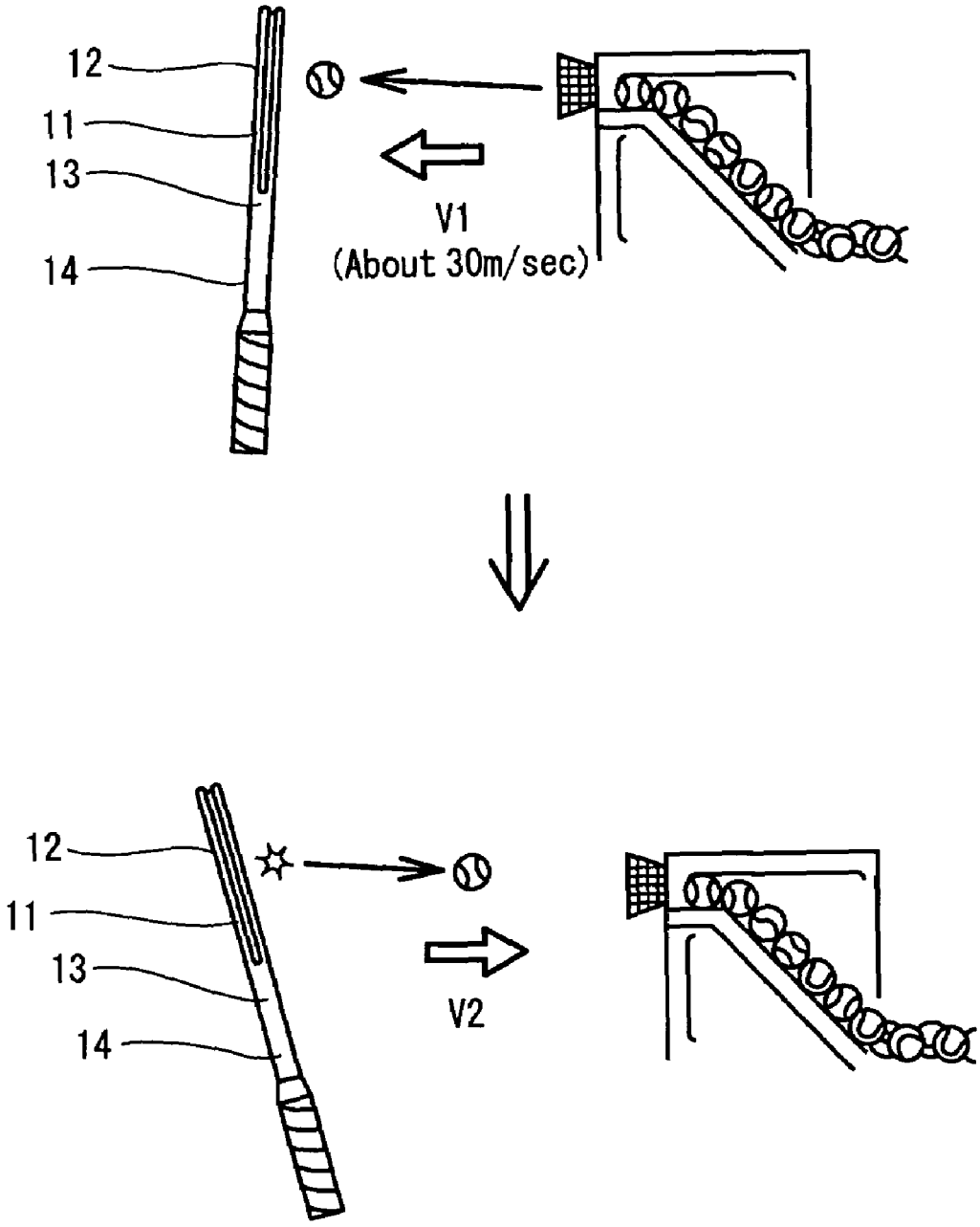
FIG. 11 is a schematic view showing the method of measuring the restitution coefficient of a racket.
Figure 12:
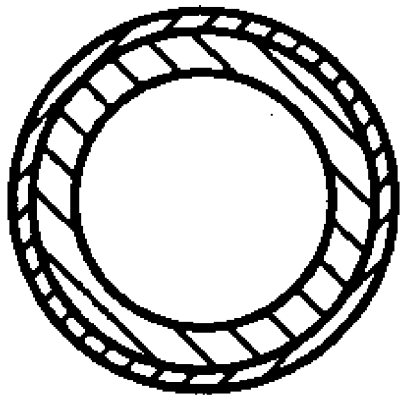
FIG. 12 shows a conventional art.

As shown in FIG. 11, strings were mounted on the racket frame of each of the examples and comparison examples at a tensile force of 60 pounds in a vertical direction and 55 pounds in a horizontal direction. The grip part 15 of each tennis racket was fixed softly in such a way that each tennis racket was free in a vertical direction. A tennis ball was launched from a ball launcher at a constant speed of V1 (30 m/sec) and collided with the ball-hitting face of the racket frame to measure the rebound speed V2 of the tennis ball. The restitution coefficient is obtained by computing the ratio of the rebound speed V2 to the launched speed V1 (V2/V1). The higher the restitution coefficient is, the higher the rebounding performance of the tennis racket is. The maximum restitution coefficient of each racket frame and a high-restitution region thereof in which the restitution coefficient is not less than 0.380 were measured in this manner.

Evaluation of Rebounding Performance and Face Stability 50 middle and high class players (having not less than 10 years' experience and currently playing tennis three or more days a week) were requested to hit balls with tennis rackets each having strings stretched on the racket frames of the examples and the comparison examples and give marks about their feeling they had when they hit balls on the basis of five (racket frame that obtained higher mark was evaluated more favorably than racket frame in rebounding performance and face stability). Table 1 shows the average of marks they gave.

As confirmed from table 1, the racket frame of the comparison example 1 in which the hard layer A was not formed had a lower rigidity value and maximum restitution coefficient and a smaller high-restitution region than the racket frames of the examples 1 through 4 having the hard layer A formed in at least one part thereof. In the evaluation of the ball-hitting test, the racket frame of the comparison example 1 was lower than those of examples 1 through 4 in the rebounding performance and the face stability thereof.

The racket frame of the example 2 was higher than the example 1 in the rigidity value and maximum restitution coefficient thereof and larger than the example 1 in the high-restitution region thereof. In the evaluation of the ball-hitting test, the racket frame of the example 2 was also higher than the example 1 in the rebounding performance and face stability thereof. In the racket frame of the example 2, after the sizing agent applied to the surface of the carbon fiber constituting the hard layer A was cleaned, the DLC film was formed on the surface of the carbon fiber. Thereby the adhesiveness of the carbon fiber to the DLC film was improved.

Comparing the racket frames of the examples 2 through 4 with each other, the more the number of layers of the hard layers A was, the higher the rigidity value and maximum restitution coefficient thereof were, the larger the high-restitution region thereof was, and the higher the rebounding performance thereof in the evaluation of the ball-hitting test. But the racket frame of the example 4 was lower than that of the examples 2 and 3 in the face stability thereof. This is because the DLC film was formed on the carbon fiber of all of the layers of the racket frame of the example 4. Thereby the weight of the racket frame of the example 4 was larger than that of the racket frames of the examples 2 and 3.

What is claimed is:

1. A tennis racket frame, made of a fiber reinforced resin, which comprises:

a plurality of reinforcing fibers including a carbon fiber; and a hard carbon film, which is formed on a surface of said carbon fiber.

2. The tennis racket frame according to claim 1, wherein said hard carbon film consists of a diamond-like carbon (DLC) film.

3. The tennis racket frame according to claim 2, wherein said fiber reinforced resin consists of a prepreg composed of fibers impregnated with a matrix resin, with said fibers drawn and arranged in one direction; and said tennis racket frame is composed of a laminate of said prepregs.

4. The tennis racket frame according to claim 3, wherein said carbon fibers are braided into a piece of cloth; a surface of said cloth is coated with said hard carbon film; and said cloth coated with said hard carbon film is impregnated with a matrix resin consisting of epoxy resin.

5. The tennis racket frame according to claim 4, wherein the thickness of said DLC film is selected in the range of 0.1 μm to 10 μm.

6. The tennis racket frame according to claim 3, wherein the thickness of said DLC film is selected in the range of 0.1 μm to 10 μm.

7. The tennis racket frame according to claim 2, wherein the thickness of said DLC film is selected in the range of 0.1 μm to 10 μm.

8. The tennis racket frame according to claim 1, wherein said fiber reinforced resin consists of a prepreg composed of fibers impregnated with a matrix resin, with said fibers drawn and arranged in one direction; and said tennis racket frame is composed of a laminate of said prepregs.

9. The tennis racket frame according to claim 8, wherein said carbon fibers are braided into a piece of cloth; a surface of said cloth is coated with said hard carbon film; and said cloth coated with said hard carbon film is impregnated with a matrix resin consisting of epoxy resin.

* * * * *